US005885010A

United States Patent [19]

Kim

[11] Patent Number: 5,885,010

[45] Date of Patent: Mar. 23, 1999

[54] PRINTER HAVING FORCED STOP FUNCTION AND FORCED STOPPING METHOD

[75] Inventor: Young-Gu Kim, Seoul, Rep. of Korea

[73] Assignee: SamSung Electronics Co., Ltd., Suwon, Rep. of Korea

[21] Appl. No.: 838,329

[22] Filed: Apr. 8, 1997

[30] Foreign Application Priority Data

Apr. 8, 1996 [KR] Rep. of Korea ..... 1996-10486

[51] Int. Cl.[6] ..... B41J 29/38

[52] U.S. Cl. ..... 400/54; 395/113; 400/74

[58] Field of Search ..... 400/54, 74; 395/113

[56] References Cited

U.S. PATENT DOCUMENTS

| | | | |
|---|---|---|---|
| 4,557,615 | 12/1985 | Ueno | 395/113 |
| 4,863,295 | 9/1989 | Miyake et al. | 400/54 |
| 4,871,272 | 10/1989 | Stein et al. | 400/54 |
| 5,133,610 | 7/1992 | Sukigara | 400/54 |
| 5,220,645 | 6/1993 | Nakajima | 395/113 |
| 5,274,461 | 12/1993 | Mitsuhashi | 358/296 |
| 5,297,876 | 3/1994 | Imagawa | 400/61 |
| 5,413,419 | 5/1995 | Oami et al. | 400/61 |
| 5,420,667 | 5/1995 | Kaneko et al. | 395/113 |
| 5,446,832 | 8/1995 | Higuchi | 395/113 |
| 5,532,792 | 7/1996 | Hattori | 395/113 |
| 5,562,351 | 10/1996 | Uematsu | 400/68 |
| 5,581,395 | 12/1996 | Prowak | 347/237 |
| 5,581,668 | 12/1996 | Oida et al. | 395/113 |
| 5,604,847 | 2/1997 | Dennis et al. | 395/116 |
| 5,716,148 | 2/1998 | Tamagakl | 400/74 |

*Primary Examiner*—Eugene Eickholt
*Attorney, Agent, or Firm*—Robert E. Bushnell, Esq.

[57] ABSTRACT

A printer has a forced stop switch to stop the printer. The switch may be pressed to stop a print output immediately when the output state of the data transmitted from a computer is bad or when the print output is not one required by a user. This prevents waste of ribbon, ink, toner, paper etc. For example, when there is an error during the printing, if the printer continuously operates, then the consumption goods such as ribbon, ink, toner, paper, etc. is consumed, and that duration of the life of printer itself is shortened. In addition, time and electric power loss that comes with the initialization of the printer caused by turning the printer off, and then on in order to remove the error, can be prevented.

8 Claims, 2 Drawing Sheets

PRINTER HAVING FORCED STOP FUNCTION AND FORCED STOPPING METHOD

CLAIM OF PRIORITY

This application makes reference to, incorporates the same herein, and claims all benefits accruing under 35 U.S.C. § 119 from an application Entitled *Printer Having Forced Stop Function And Forced Stopping Method* earlier filed in the Korean Industrial Property Office on 8 Apr. 1996, and there duly assigned Ser. No. 96-10486 by that Office, a copy of which application is annexed hereto.

BACKGROUND OF THE INVENTION

1. Field of the Invention

The present invention relates to a printer. More particularly, the present invention relates to a printer with a forced stop switch to stop the printing operation immediately when the output state of data transmitted from a computer contain unacceptable errors or when the print output is not required by a user, and a method to effectuate thereof.

2. Discussion of Related Art

Typically, a printer is used to print data, transmitted from a computer, onto a paper in the form of characters or graphics. Even when data transmission to the printer is interrupted by the control of the computer (such as when data errors occur in the course of the operation of a conventional printer), the printer continues to operate. This is because data temporarily stored in the print buffer remains. Therefore, paper, ink, toner or ribbon may be wasted and the duration of printer shortened, in accordance with this wasteful printing operation.

When data transmitted to the printer from the computer is interrupted and the printer is turned off, data stored in the print buffer is deleted, and the printer does not operate. The printer must be turned on to operate, and the initialization routine must be completed before further output can be generated. Much time is required in accordance with unnecessary printing operations when the printer is initialized. Further, electric power is wasted and the printer would require another wasteful set-up. These problems are not adequately addressed in the contemporary practice. The contemporary practice does not even adequately address the memory management in this situation. An exemplar of the contemporary practice is Prowak (U.S. Pat. No. 5,581,295, *Method And Apparatus For Resequencing Image Data For A Printhead*, Dec. 3, 1996) discussing a memory that is sequentially addressed so that the data stored at successive addresses are sequentially output from the memory in a sequence suited for the type of printhead. Uematsu (U.S. Pat. No. 5,562,351, *Printer Having Constant And Variable Data Memory*, Oct. 8, 1996) discusses a printer having a storage area for storing predetermined constant data and variable data, and at least a first and second image data storage area for storing image data. Imagawa (U.S. Pat. No. 5,297,876, *Page Printer With Internal And External Memories,* Mar. 29, 1994) discusses a page printer provided with an external memory for storing prepared page data and control section for alternatively selecting either the external memory or the page data preparing section. Mitsuhashi (U.S. Pat. No. 5,274,461, *Image Processing Apparatus Which Predicts When To Prepare For Image Forming Operations*, Dec. 28, 1993) discusses a developing unit developing the coded data into bit map data. A predicting unit transmits a timing signal for starting preparatory operations by the printing unit with a timing base on the predicted time. Oami et al. (U.S. Pat. No. 5,413,419, *Printer, A Printer Control System And Method*, May 9, 1995) discusses a printer having a buffer memory for temporarily storing new print data, and is concerned with paper jam situations. Dennis et al. U.S. Pat. No. 5,604,847, *System And Method Of Printer Banding*, Feb. 18, 1997) discusses printer banding by which stored printer data files are processed a single time to create a set of bandable primitives corresponding to the entire page to be printed. From my study of the contemporary practice and art, I find that there is a need for an effective printer for handling a situation when the printer is forced to stop, especially as to effective handling of the memory containing the print data.

SUMMARY OF THE INVENTION

Therefore, an object of the present invention is to provide a printing device and method in which the data transmission from the computer to the printer can be interrupted by pressing a forced stop switch on one side of the printer. This should immediately stop the printing operation when there are errors in the print data.

Another object of the present invention is to provide a printer whose print operation can be stopped even when the printer is not turned off, so that the inconvenience and waste of resetting the print mode can be eliminated.

To achieve these and other objects of the present invention, the printer of the present invention may include a panel for displaying the state of setup of print mode and light emitting diode. A communication port receives the data transmitted from a computer to print. A random access memory stores the print data which is transmitted from the computer through the communication port. A read only memory stores programs governing various operations of the printer. The printer may also include a central processing unit for executing the programs stored in read only memory to generate general control signals, a motor drive unit where paper feed (and discharge) motors and carriage return motors are driven, and a head drive unit (for controlling a head). A forced stop switch is located at on the panel to stop the print operation. The program concerning the operations, in accordance with the use of the forced stop switch, is stored in read only memory.

The forced stop method of the present invention includes the steps of confirming the state of the forced stop switch, transmitting a forced stop signal through the communication port in order to interpret the data transfer from the computer, turning on the light emitting diode error signal by generating an error message for the panel, and clearing the print buffer. The paper, in the process of being printed, should be discharged in order to print on the next paper. The other steps may be: clearing the forced stop signal (which is being transmitted to the computer through the communication port), and turning off the light emitting diode warning light on the panel in order to notify a user of termination of the forced stop operation.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIG. 1 is a block diagram illustrating a printer according to the present invention; and FIG. 2 is a flow chart illustrating a forced stop method according to the present invention.

DETAILED DESCRIPTION OF PREFERRED EMBODIMENT

Figure 1:
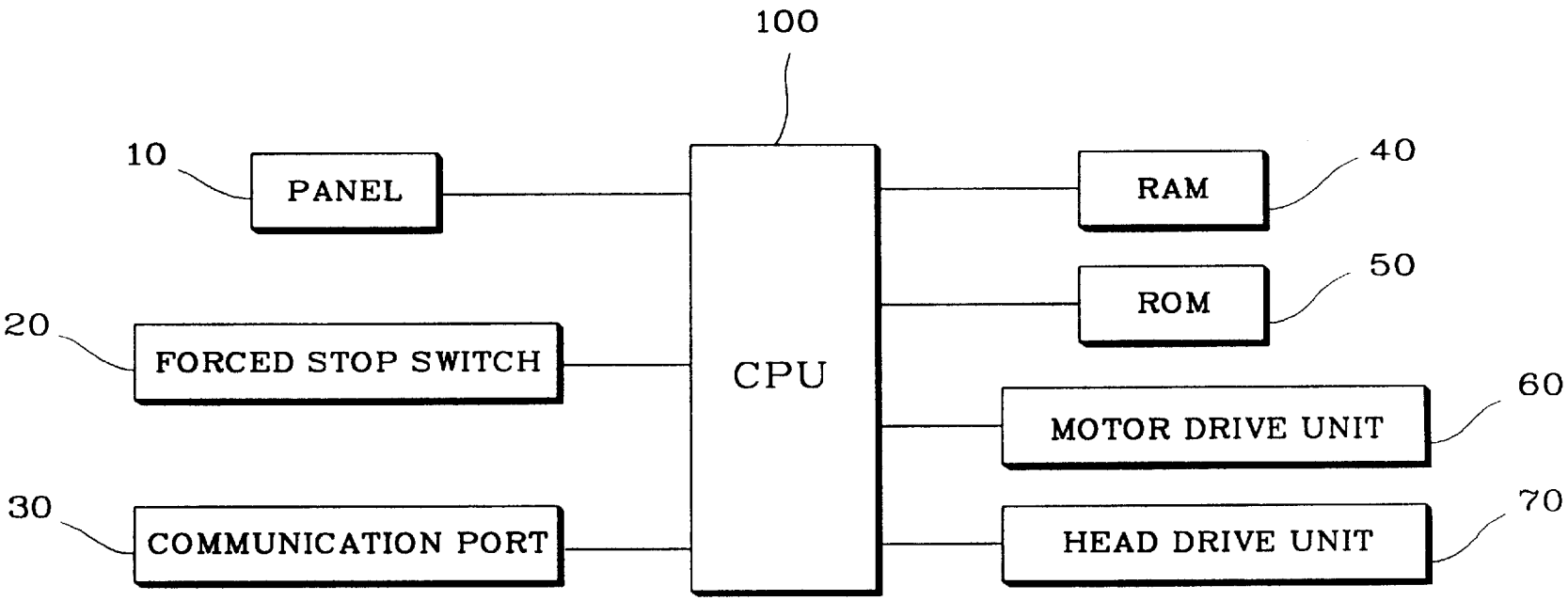
Figure 2:
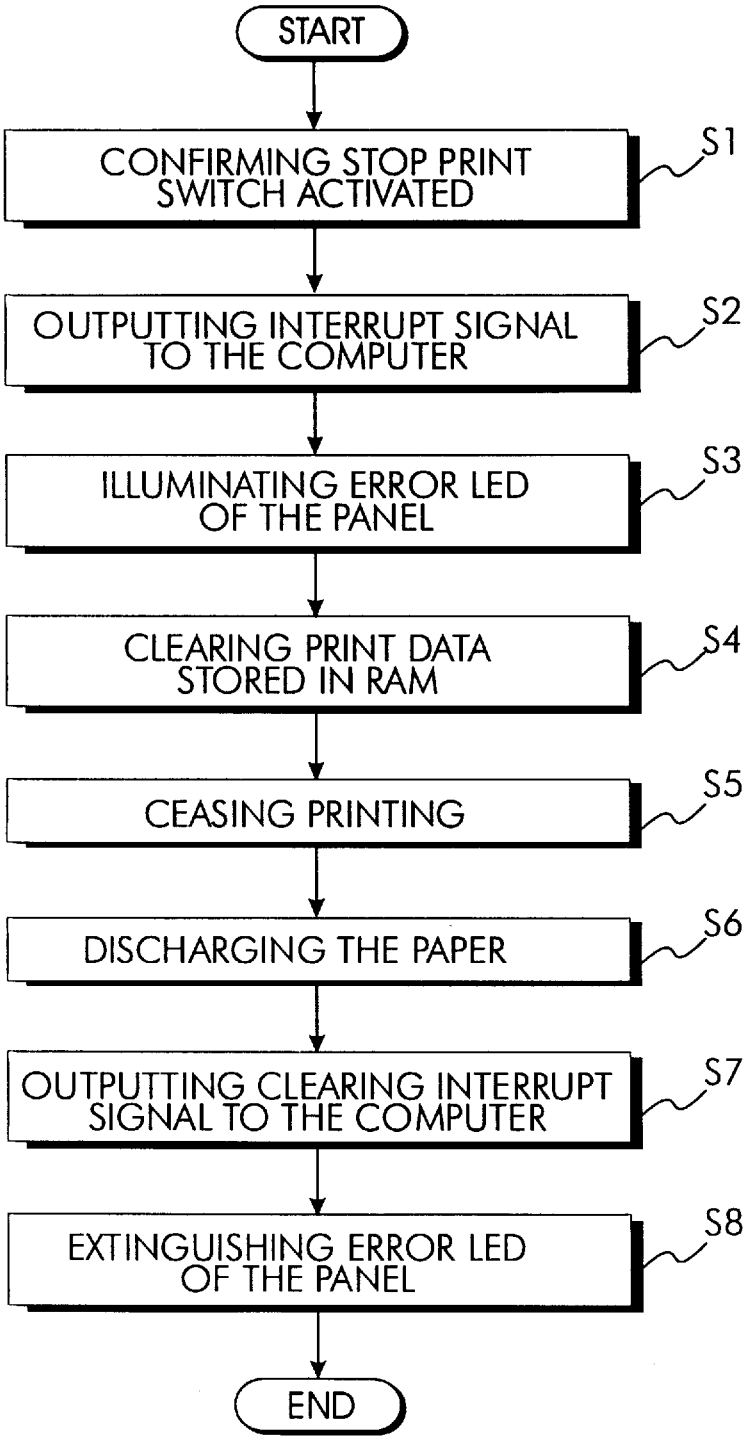

Turning now to the drawings, as shown in FIG. 1, the printer of the present invention includes a panel 10 for displaying the state of setup of print mode and a light emitting diode warning lamp. A forced stop switch 20 is installed at fixed portion of the panel 10 in order to forcibly stop the print operation. A communication port 30 can be used for receiving the document to print, that is, data transmitted from a computer. Random access memory 40 stores the document, that is, data which is transmitted from the computer through the communication port 30. Read only memory 50 stores the program in accordance with the use of the forced stop switch 20. Central processing unit 100 can be used for executing the program stored in read only memory 50, and generating general control signals. A motor drive unit 60 is where paper feed/discharge and carriage return motors are driven. A head drive unit 70 controls the print head.

The following explains a forced stop method of a printer (which can be as in FIG. 1). When the document, data transmitted to the printer by from the computer by a user, contains errors, forced stop switch 20 installed on panel 10, must pressed to stop the printing operation. CPU 100 receives this signal (step S1), and transmits an error signal back through the communication port 30 in order interrupt the data transfer (step S2). The error generating light emitting diode is turned on in order to notify the user of the necessary action taken against the error (step S3). After this, the data, which was transmitted from the computer and stored in the print buffer, is cleared (step S4).

The operation of motor drive unit 60 and head drive unit 70 is stopped to stop the print operation (step S5). The paper, which is being printed, is discharged to print further documents on a different paper (step S6). The error signal is cleared, allowing the printer to again receive data from the computer (step S7). The error generating light emitting diode is turned off to notify the user of termination of the forced stop operation (step S8).

As mentioned above, the present invention prevents the situation of executing the forced stop even if there is an error during the printing. In such a forced stop (which would be ill-timed) the printer continuously operates so that the consumption goods such as ribbon, ink, toner, paper, etc. are consumed, and the life of printer itself is shortened. Also, time and electric power loss in accordance with the initialization of the printer can be caused by this ill-timed method of turning off, and then turning on the printer in order to remove the error. This can be prevented. This is prevented by the present invention.

It will be apparent to those skilled in the art that various modifications and variations can be made to a printer having forced stop function and a forced stop method of the present invention without departing from the spirit or scope of the invention. Thus, it is intended that the present invention cover the modifications and variations of this invention provided they come within the scope of the appended claims and their equivalents.

What is claimed is:

1. A printer comprising:

a panel to display a state of setup of print mode, said panel including a warning lamp having a light emitting diode;

a communication port to receive print data to be printed, the print data being transmitted from a computer;

a random access memory to buffer a print operation of printing the print data transmitted from the computer via said communication port;

a read only memory to store a control program controlling the printer;

a central processing unit to execute the control program and to generate general control signals;

a motor drive unit controlling a paper feed and discharge mechanism for paper feed and discharge and controlling a carriage return mechanism for carriage return;

a head drive unit controlling a print head for printing;

a manually activated forced stop switch located on the panel signaling to said central processing unit; and said central processing unit detecting whether said forced stop switch has been subjected to manual activation by a user of the printer, verifying whether said forced stop switch has been subjected to said manual activation, immediately stopping transference of printing media to paper in response to verification of said manual activation of said forced stop switch according to a stop program stored in said read only memory, transmitting an error signal from the printer to said computer to instruct said computer to discontinue transmission of the print data, and transmitting an error clear signal from the printer to said computer to instruct said computer to transmit the print data.

2. The printer of claim 1, wherein said forced stop switch is installed at a front upper location of said panel of the printer.

3. The printer of claim 1, wherein said panel displays information and indicates errors in the information that do not conform to expected values when the errors occur.

4. The printer of claim 1, wherein the print operation stops when said forced stop switch is manually pressed by a human user.

5. The printer of claim 2, wherein said panel displays information and indicates errors in the information when the errors occur.

6. The printer of claim 2, wherein the print operation stops when said forced stop switch is manually pressed by a human user.

7. The printer of claim 3, wherein the print operation stops when said forced stop switch is manually pressed by a human user.

8. The printer of claim 5, wherein the print operation stops when said forced stop switch is pressed.

* * * * *